US006256906B1

(12) United States Patent
Matis et al.

(10) Patent No.: US 6,256,906 B1
(45) Date of Patent: Jul. 10, 2001

(54) HINGED SANDAL STRAPPING SYSTEM

(75) Inventors: Clark A. Matis, Charlotte, VT (US); Jacques Lavertue, Rockford, MI (US); Bruce Rogers, Portland, OR (US)

(73) Assignee: Wolverine World Wide, Inc., Rockford, MI (US)

( * ) Notice: Subject to any disclaimer, the term of this patent is extended or adjusted under 35 U.S.C. 154(b) by 0 days.

(21) Appl. No.: 09/163,046

(22) Filed: Sep. 29, 1998

Related U.S. Application Data

(63) Continuation-in-part of application No. 29/088,611, filed on May 28, 1998.

(51) Int. Cl.[7] ..... A43B 3/12; A43C 11/00
(52) U.S. Cl. ..... 36/11.5; 36/50.1
(58) Field of Search ..... 36/11.5, 50.1

(56) References Cited

U.S. PATENT DOCUMENTS

| | | | | |
|---|---|---|---|---|
| 2,112,761 | * | 3/1938 | Buehner | 36/11.5 |
| 2,266,732 | * | 12/1941 | Babinchak | 36/11.5 |
| 2,368,514 | * | 1/1945 | Baehr | 36/11.5 |
| 3,000,116 | * | 9/1961 | Ally | 36/11.5 |
| 3,698,107 | * | 10/1972 | Fukuoka | 36/11.5 |
| 4,107,856 | * | 8/1978 | Bourque | 36/50.1 |
| 5,465,506 | | 11/1995 | Matis et al. . | |
| 5,533,278 | | 7/1996 | Stein . | |

OTHER PUBLICATIONS

Fila Sports—Sandals pricing page.
Teva 1997 Catalog.
ACG Fall 1998 Catalog—selected pages.
Merrell 1997 Catalog—selected pages.
Merrell Spring & Summer 1996 Catalog—selected pages.
Technica Outdoors Collection 1999 Catalog—selected pages.
ACG Spring 1999 Catalog—selected pages.

* cited by examiner

*Primary Examiner*—M. D. Patterson
(74) *Attorney, Agent, or Firm*—Warner Norcross & Judd LLP

(57) ABSTRACT

A sandal construction, including a sole and a strapping system for retaining the sole of a foot. The strap system includes ankle and heel straps pivotally attached directly to inner and outer support members for ease of wear and comfort. Rivet pins pass through the exterior layers of the support members and through the ends of the ankle and heel straps and are secured by rivet heads. The ankle and heel straps may be adjusted to accommodate an individual foot, such as heel position and instep height.

5 Claims, 11 Drawing Sheets

HINGED SANDAL STRAPPING SYSTEM

This is a Continuation-In-Part of application Ser. No. 29/088,611, filed May 28, 1998, pending.

BACKGROUND OF THE INVENTION

The present invention relates to a sandal construction and, more particularly, to a sandal strapping system for securing a sandal to a foot.

Sandals that include a sole and a strapping system for retaining the sole against the bottom of a foot are well-known in the prior art. Typical sandals of this type include a front strap for retaining the front portion of the foot against the sole, and ankle and heel straps for retaining the rear portion of the foot against the sole. The front strap extends over the front portion of the foot and includes opposite ends which are affixed to the sole. Additionally, the ankle strap extends over the top surface of the foot and includes opposite ends affixed to inner and out support members or directly to the sole. The heel strap wraps around the rear heel portion of the foot and, like the ankle strap, is affixed to the support members or directly to the sole.

Commonly, sandal straps are adjustable lengthwise for accommodating feet of various heights and widths and to adjust the snugness of the strap to the foot. An adjustable strap system is seen in U.S. Pat. No. 5,465,506 to Matis et al, issued Nov. 14, 1995. The '506 patent discloses a buckle with adjustable loop which permits adjustment of the length of the ankle strap. Adjustable length straps improve the performance and comfort of the strap system. However, these straps do not fully accommodate the individual shapes of feet, such as various heel heights and ankle positions. Instead, the ankle and heel straps are manufactured and affixed to the sole in a standard position, for example, at a forty five degree angle which respect to the sole, and are not adjustable by the user. Stationary straps may be positioned incorrectly for a wearer's foot, such as the ankle strap being angled too low or too high so that its edge rubs the skin on the upper surface of the foot. Incorrect strap positioning is not only uncomfortable, but it may also cause irritation and blisters on the skin of the wearer.

Another strapping system can be seen in U.S. Pat. No. 5,533,278 to Stein, issued Jul. 9, 1996. In this patent, vertical inner and outer posts extend from the sole in the rear portion of the shoe. The heel and ankle straps are loosely attached to the posts by triangular connectors. Although this connection permits some movement the triangular connectors bias the straps in a single position. If the straps are ill-fitting, their edges may rub the top of the wearer's foot or his or her heel. Additionally, this loose-styled connection permits relatively free lateral movement of the straps and may not provide adequate lateral support to the foot.

SUMMARY OF THE INVENTION

The present invention overcomes the noted problems by providing a sandal construction with pivotally hinged ankle and heel straps, thus allowing the straps to move to or be placed in a comfortable position while providing lateral support.

The sandal includes a sole and a strapping system for retaining the sole on a foot. The strapping system includes a front strap, which is preferably length adjustable. The ends of the front strap are affixed to the front portion of the sole to retain the front portion of the foot against the sole. The strapping system further includes inner and outer support members which are attached to and extend upwardly from the rear portion of the sole. The ends of the ankle and heel straps are secured directly to and extend between the upper portions of the inner and outer support members.

In the preferred embodiment, the ends of the ankle and heel straps are attached to the support members by individual rivets, which permit the ankle and heel straps to pivot across a wide range of motion. As the wearer slips his foot into the sandal the straps may pivot, or the wearer may rotate the straps manually, so that they accommodate an individual foot, thus lessening irritation and rubbing. The ends of the ankle and heel straps preferably overlap and directly engage the support members. This direct attachment of the straps to the support members restricts independent lateral movement of the straps and enhances the lateral support the sandal provides to the foot.

The present invention provides a simple and effective sandal strapping system that is both comfortable and easy to operate. The pivotally hinged attachment between the support members and the ankle and heel straps allows a broad range of pivotal adjustment of the straps. Further, the position and direct attachment of the straps provides significant lateral support.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
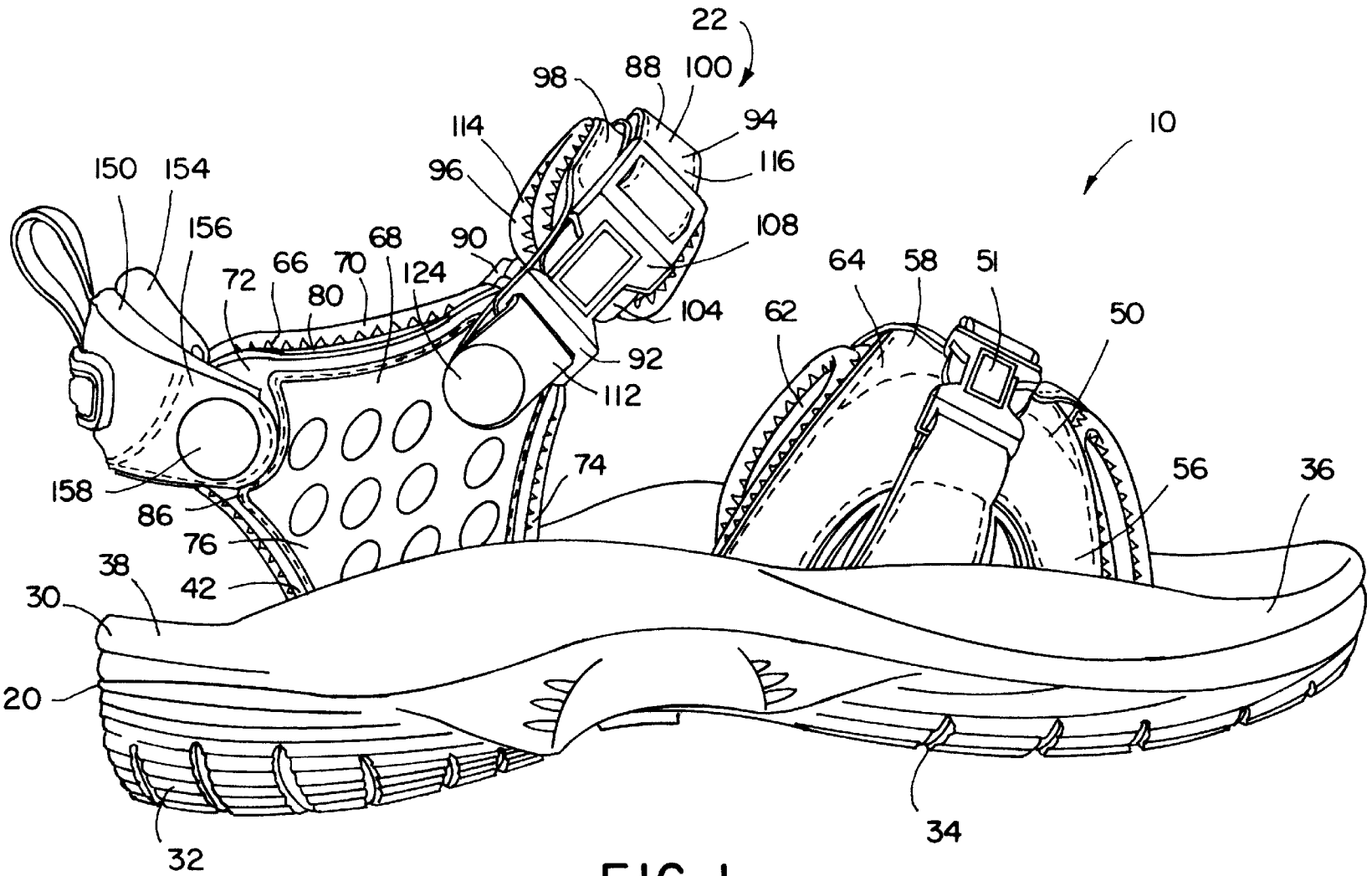
FIG. 1 is a right side elevational view of the sandal including the hinged strapping system.
Figure 2:
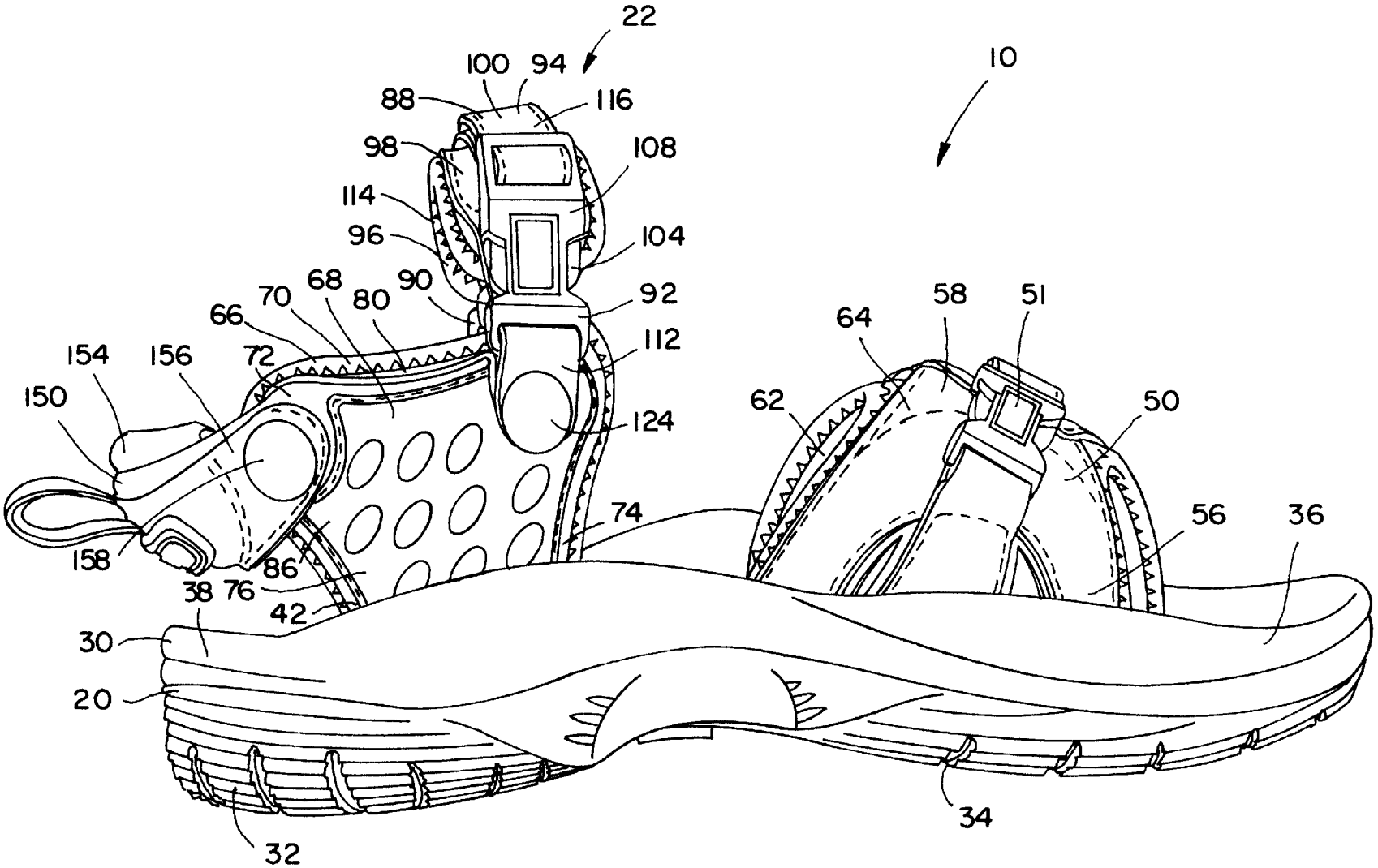
FIG. 2 is a right side elevational view of the sandal with the ankle and heel straps moved to different positions.
Figure 3:
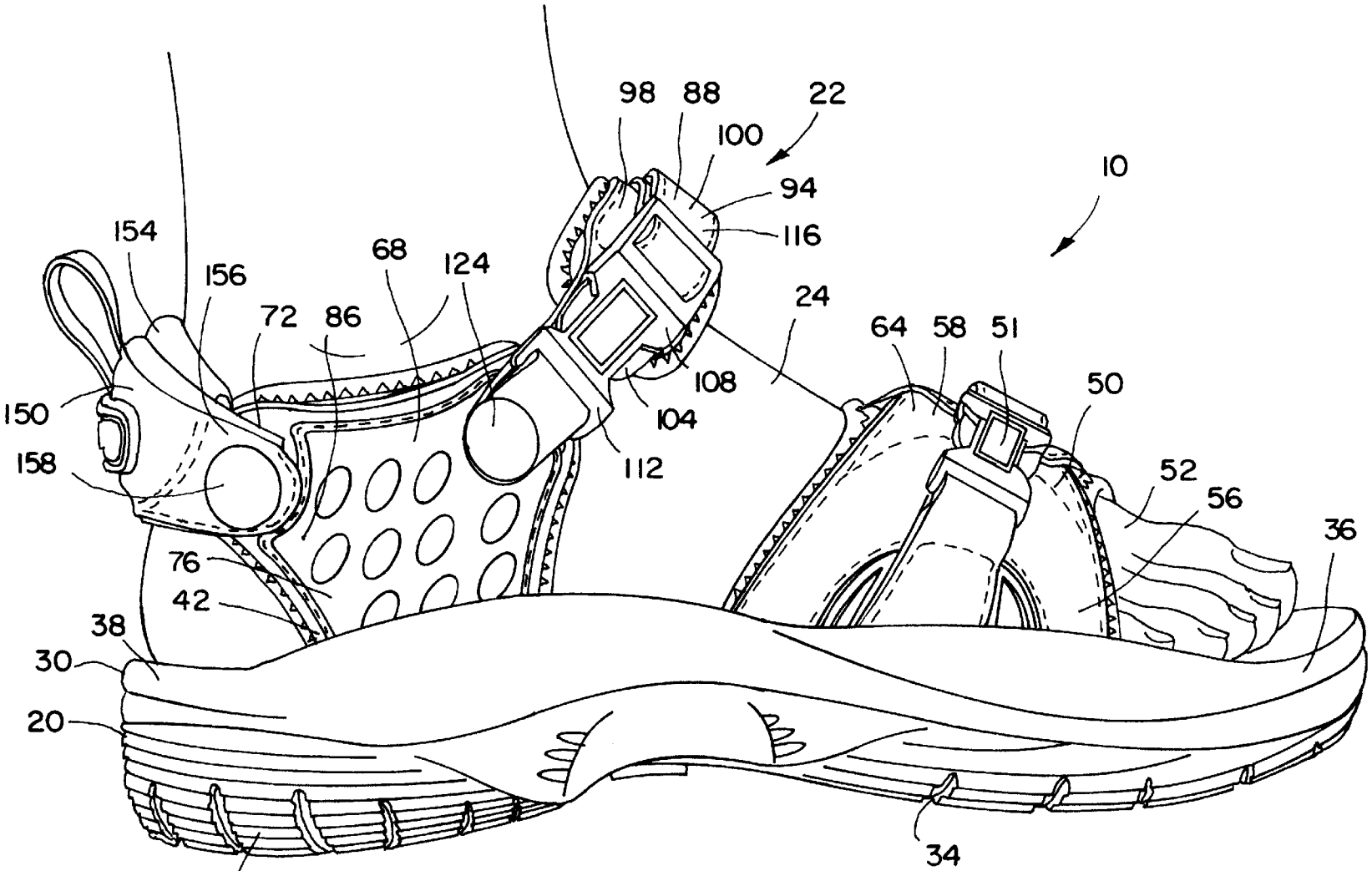
FIG. 3 is a right side elevational view of the sandal being worn with the ankle and heel straps positioned for the wearer's comfort.
Figure 4:
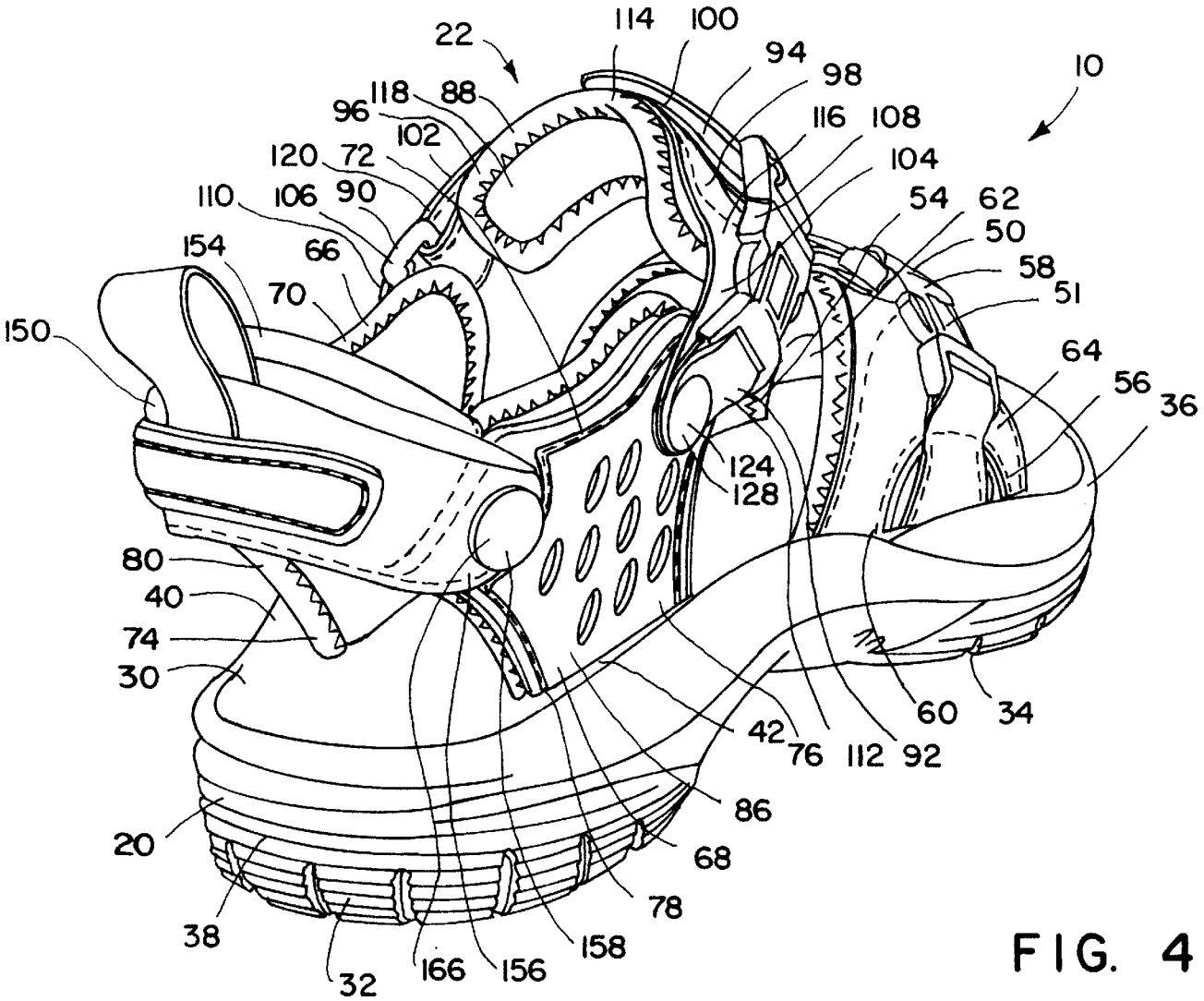
FIG. 4 is a rear perspective of the sandal with the hinged strapping system.

A sandal according to a preferred embodiment of this invention is illustrated in FIGS. 1–4 and generally designated 10. The illustrated sandal 10 is intended to be worn on the right foot and will be described in detail; a sandal to be worn on the left foot may, of course, be the mirror image of the illustrated sandal 10.

The sandal 10 includes a sole 20 and a strapping system 20 for retaining a wearer's foot 24 on the sole 20. The sole 20 is typically molded of rubber or plastic, although other materials and methods of manufacture may be used. Additionally, the sole 20 may be formed to conform generally to a foot 24. The sole 20 is comprised of an insole 30, also commonly called an upper sole, which engages the wearer's foot, and an outsole 32, commonly called a lower sole, which engages the ground and forms the wear surface of the sandal. The insole 30 is preferably configured to generally conform to the underside of a foot 24 and is fashioned for comfort. The outsole 32 generally is more rugged and configured for traction and durability. Additionally, the bottom tread 34 of the sole 20 may be roughened or otherwise configured to enhance traction. The insole 30 and outsole 32 may be secured to each other by various conventional techniques, such as by bonding with glue or cement or by stitching.

The sole 20 further includes front and rear portions 36 and 38 and opposing side edges, termed the inner, or medial, edge 40 and the outer, or lateral, edge 42. When worn, the inner edge 40 of the illustrated sandal 10 for the right foot will face the inner edge of a sandal for the left foot.

The strapping system 22 includes a front strap 50 for retaining the front 52 of the foot 24 on the sole 20. The front strap 50 may be adjustable lengthwise by a buckle 51, or other elements, to accommodate feet of different heights and widths. The front strap 50 includes inner and outer ends 54 and 56 and a middle portion 58. The ends 54 and 56 are secured to the front portion 36 of the sole 20 preferably by passing the ends 54 and 56 through holes 60 defined by the insole 30 and securing the ends 54 and 56 to the underside (not shown) of the insole 30. However, other various conventional methods, such as sewing or riveting, may be used to secure the front strap 50 to the sole 20. The interior layer 62 of the front strap 50 is preferably constructed of a flexible and relatively soft material such as cambrelle, so as not to chafe or rub the wearer's foot 24. The exterior layer 64 of the front strap 50 is preferably manufactured of leather, canvas, or other suitably durable material.

The strapping system 22 further includes inner and outer support members 66 and 68 attached to the inner and outer sides 40 and 42, respectively, of the rear portion 38 of the sole 20. The support members 66 and 68 have upper and lower portions 74 and 76 and are preferably secured to the sole 20 by passing the lower portions 74 and 76 through apertures 78 defined by the insole 30 and securing them to the underside (not shown) of the insole 30, similarly to the front strap 50. Of course, other conventional techniques may be used, such as sewing or riveting.

Both support members 66 and 68 include interior and exterior layers 80, 82, 84, and 86. The interior layers 80 and 82 are preferably constructed of a flexible and cushioned material, such as neoprene covered with spandex or other material having similar properties. The exterior layers 84 and 86 preferably are constructed of rubber, a flexible plastic, or other suitable material that provides wear and durability. The interior and exterior layers 80 and 84 and 82 and 86 are preferably sewn to each other, although other conventional securing means, such as gluing, may be used.

The strapping system 22 further includes an ankle strap 88 having inner and outer ends 90 and 92 and a middle portion 94. The ankle strap 88 is pivotally attached (as discussed below) to the upper portions 70 and 72 of the support members 66 and 68; the inner end 90 is directly attached to the inner support member 66, and the outer end 92 is attached to the outer support member 68.

The ankle strap 88 has an interior layer 96 and an exterior layer 98. The interior layer 96 is preferably cushioned and constructed of material similar to that used for the interior layers 80 and 82 of the support members 66 and 68. The exterior layer 98 is preferably constructed of leather or other durable material, similarly to the exterior layer 64 of the front strap 50. The exterior layer 98 includes a middle portion 100 and inner and outer ends 102 and 104. The middle portion 100 is secured to the interior layer 96. The inner end 102 of the exterior layer 98 passes through an inner connecter 106, loops back across the exterior layer 98, and attaches to a buckle 108 used to adjust the length of the ankle strap 88. An inner connecting strip 110 additionally loops through the inner connector 106 and secures the ankle strap 88 to the inner support member 66. An outer connecting strip 112 loops through the buckle 108 and secures the ankle strap 88 to the outer support member 68.

The inner and outer connecting strips 110 and 112 are preferably manufactured of material pieces folded upon themselves. Preferably, each strip 110 and 112 has an exterior layer 114 and 116 of leather or synthetic leather material for durability and an interior layer 118 and 120 of a cambrelle material or similarly matching material as used on other portions of the sandal 10.

Figure 5:
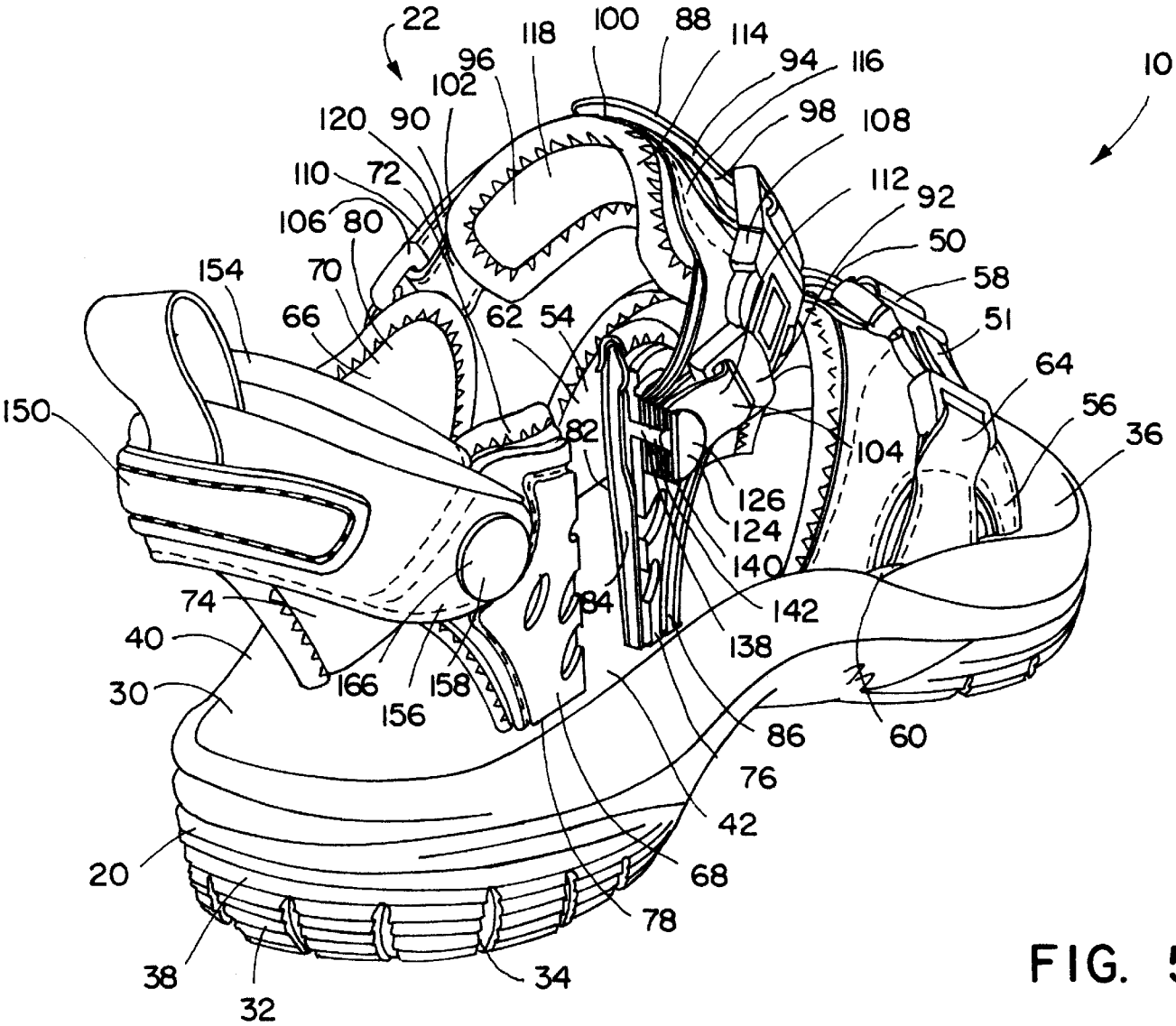
FIG. 5 is a cut-away view of the hinged connection between the supporting member and the ankle strap.
Figure 7:
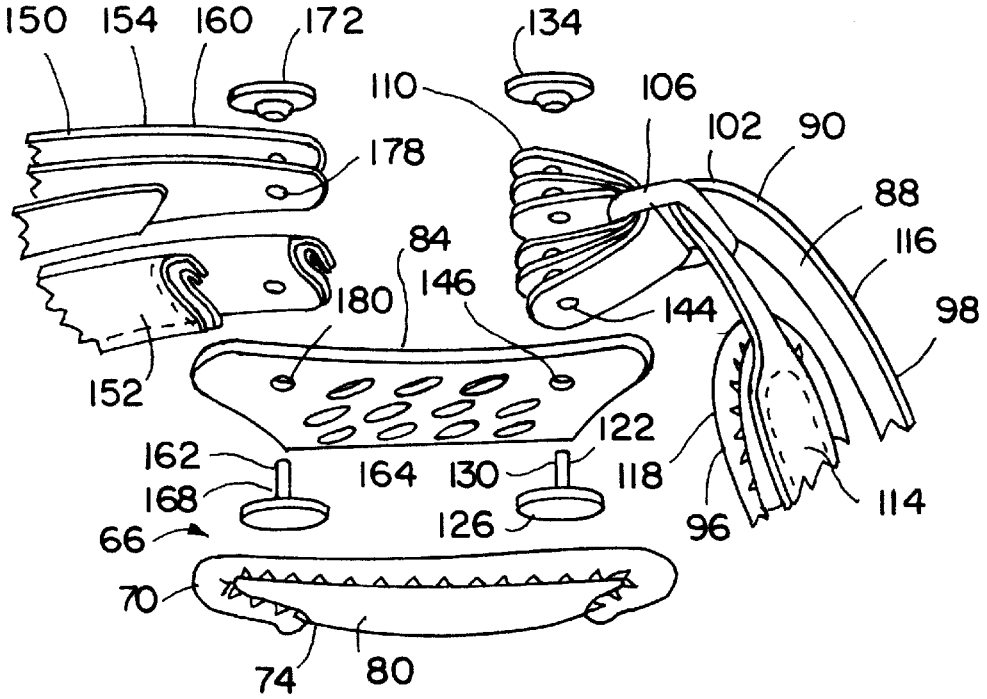
FIG. 7 is a top plan exploded view showing the hinged connections between the supporting member and the ankle and heel straps.
Figure 7:
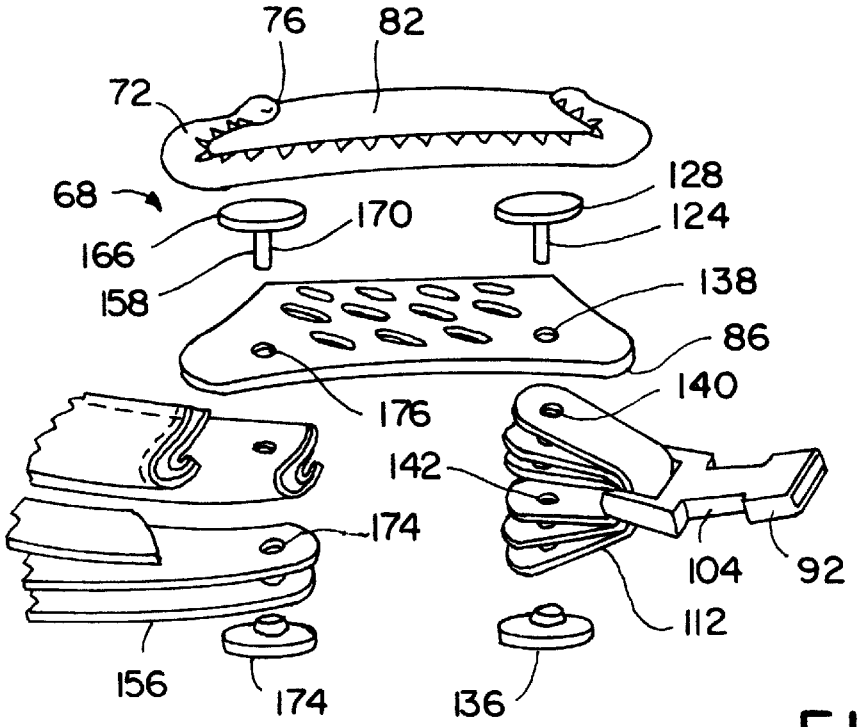
Figure 8:
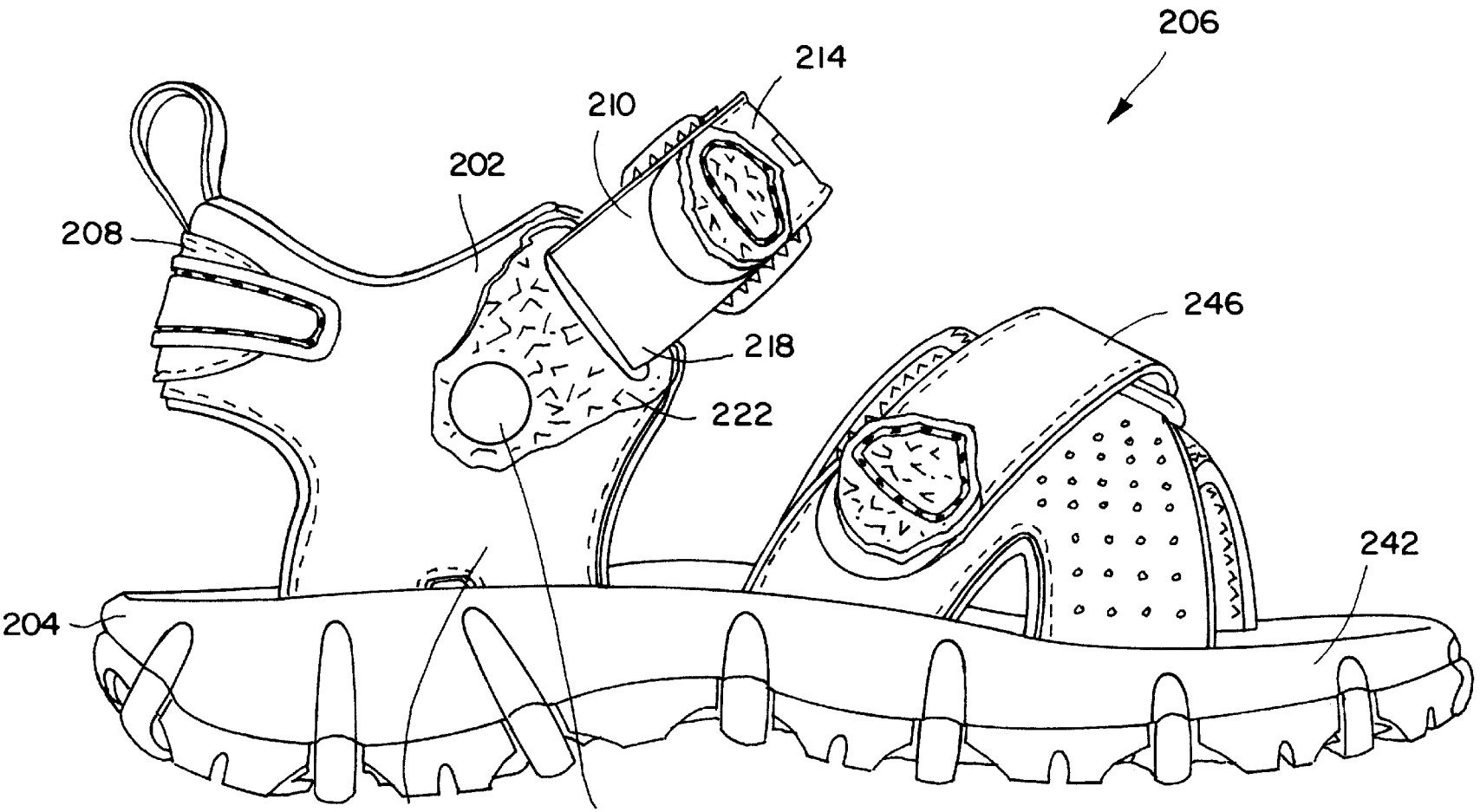
FIG. 8 is a right side elevational view of an alternative embodiment of the sandal having a hinged ankle strap.
Figure 9:
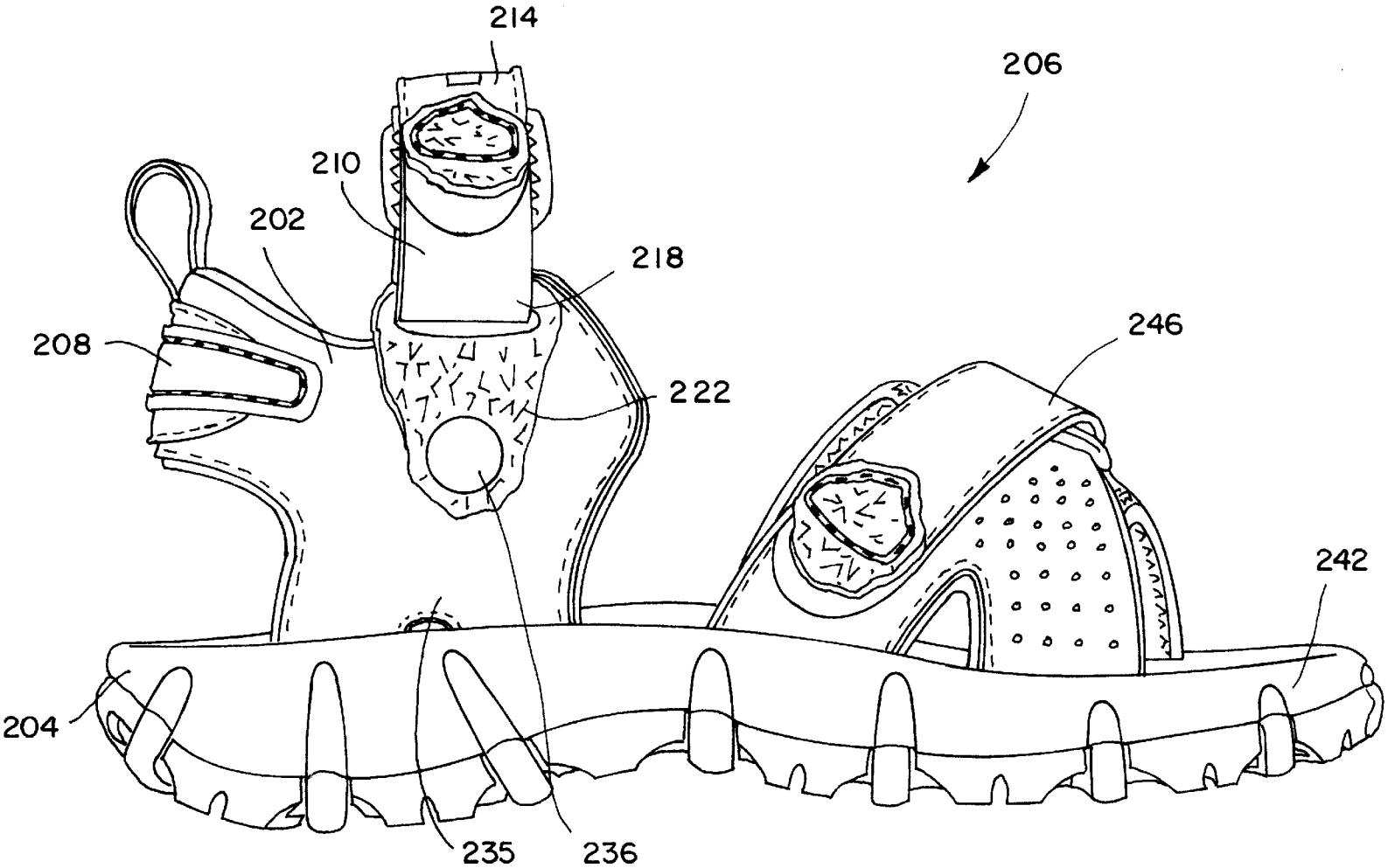
FIG. 9 is a right side elevational view of the alternative embodiment showing the ankle strap moved to a different position.
Figure 10:
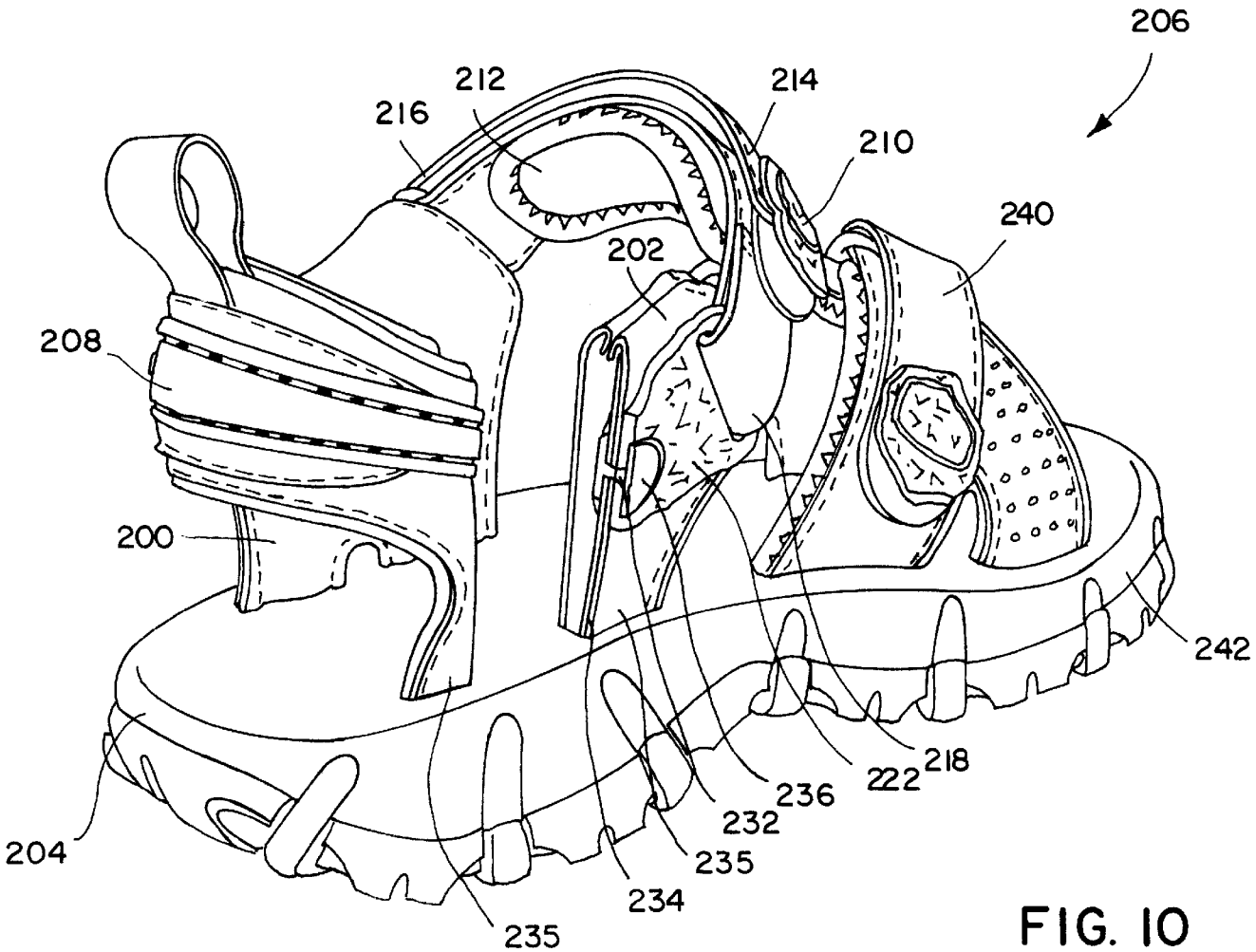
FIG. 10 is a cut-away view of the alternative embodiment showing the hinged connection between the ankle strap and the supporting member.
Figure 11:
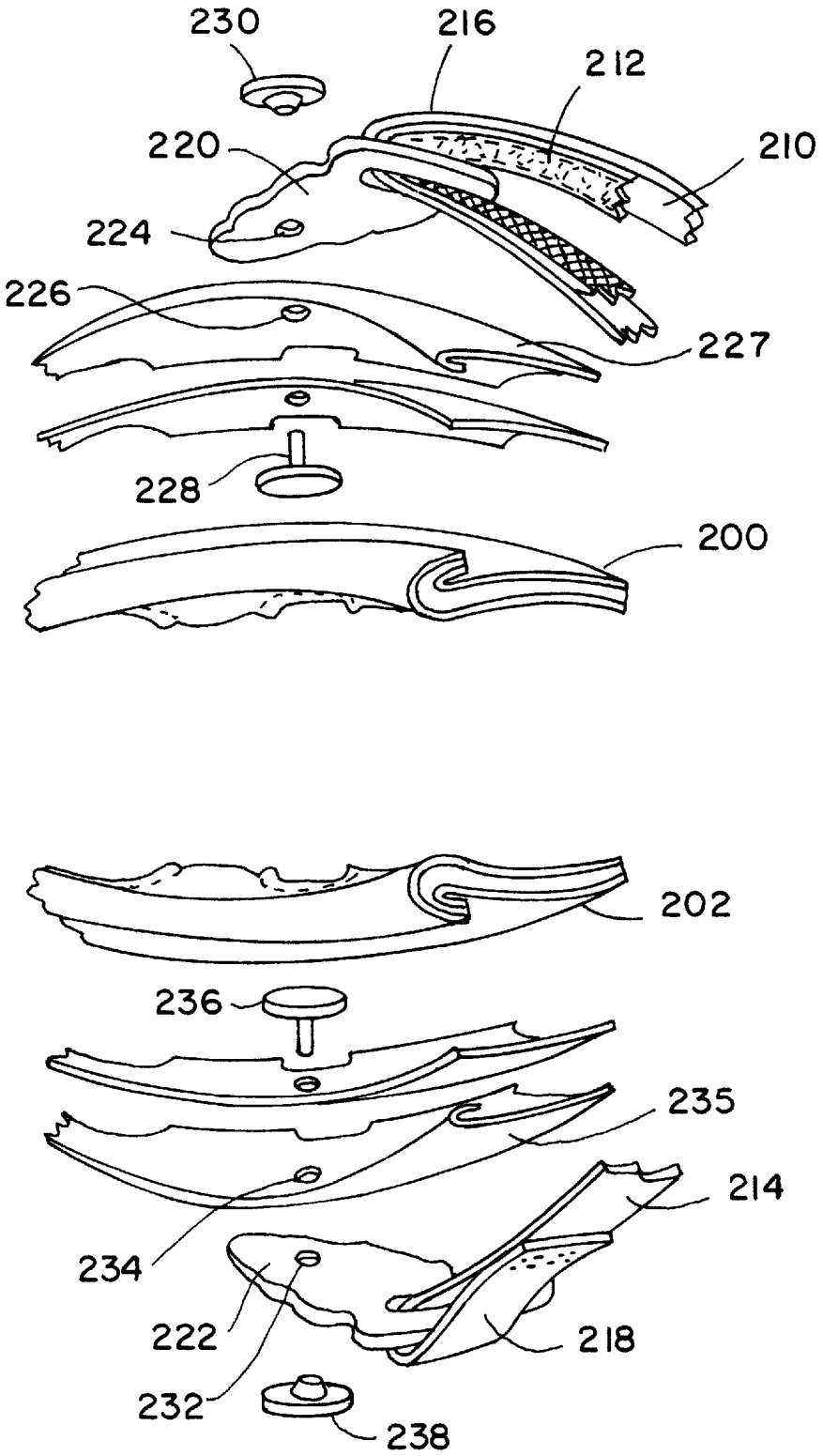
FIG. 11 is a top plan exploded view of the alternative embodiment showing the hinged connection between the supporting member and the ankle strap.

As seen in FIGS. 5 and 7, the ankle strap 88 is secured to the inner and outer support members 66 and 68 by inner and outer ankle pivot connections 122 and 124. Each ankle pivot connection 122 and 124 preferably includes an ankle rivet 126 and 128 having an ankle rivet head 130 and 132 and an ankle rivet pin 134 and 136.

The outer ankle rivet pin 132 passes through apertures 138, 140, and 142 defined by the exterior layer 86 of the outer support member 68, the outer end 104 of the exterior layer 98 of the ankle strap 88, and the outer connecting strip 112. The outer ankle rivet head 136 is secured on the end of the outer ankle rivet pin 132 to hold the pin 132 in place.

The inner ankle rivet pin 130 passes through apertures 144 and 146 defined by the inner connecting strip 110 and the exterior layer 84 of the inner support member 66. The inner ankle rivet head 134 is affixed to the end of the inner ankle rivet pin 130 to hold the pin 130 in place.

Thus, the ankle strap 88 may rotate about the inner and outer ankle rivet pins 130 and 132 and be positioned for comfort. For example, if the wearer has a high instep, the ankle strap 88 may be pivoted to a higher, more vertical position so that the edge of the strap 88 does not chafe or irritate the skin on the top of the wearer's foot 24. The ankle strap 88 may pivot to the correct position as the wearer slips a foot into the sandal 10, or the wearer, if a different position is desired, may rotate the strap 88 to a new position.

Figure 6:
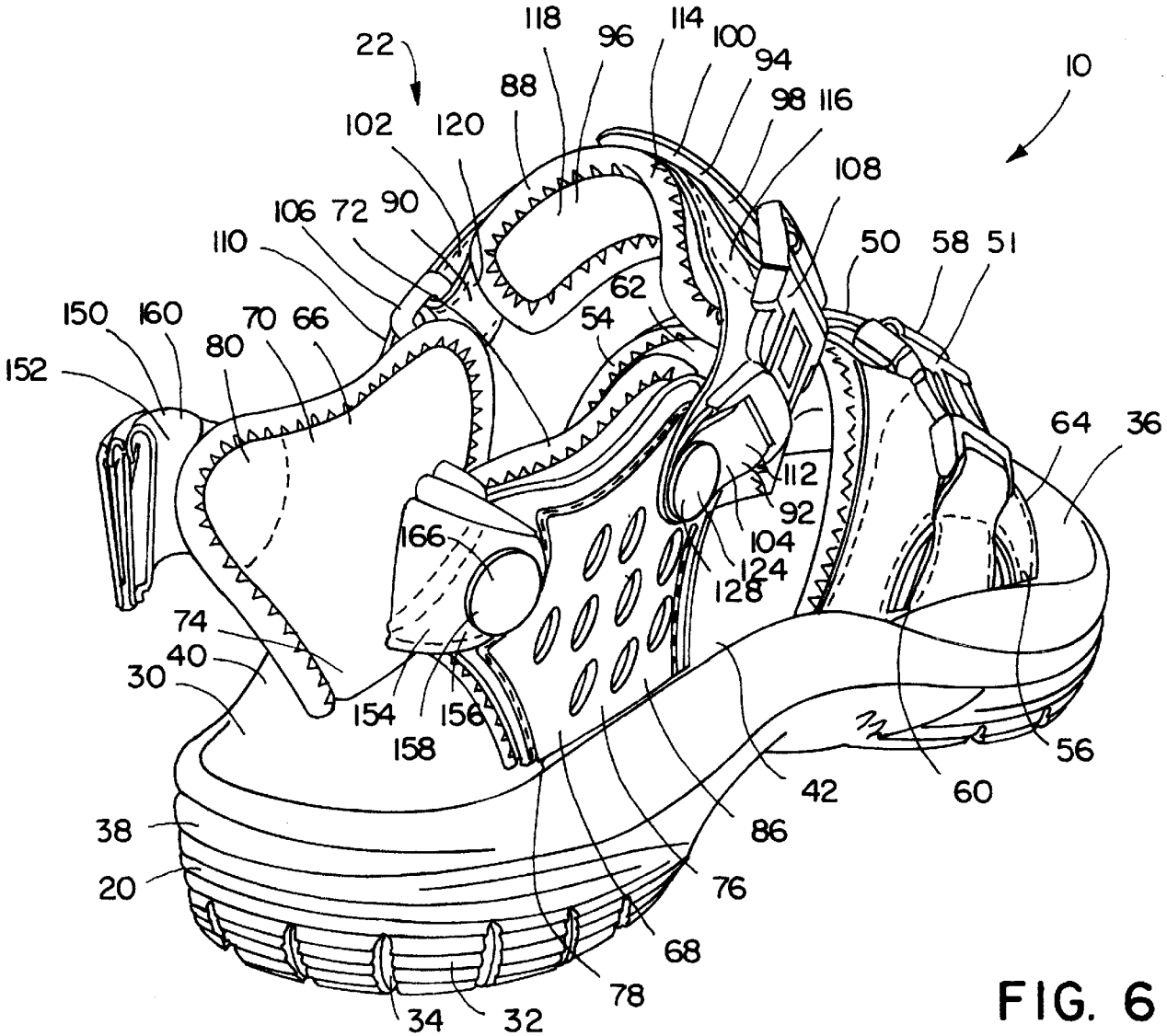
FIG. 6 is a cut-away view showing the interior of a supporting member.

As seen in FIGS. 6 and 7, a heel strap 150 is pivotally attached to the inner and outer support members 66 and 68. The heel strap 150 is preferably constructed with a neoprene interior layer 152 for comfort and an exterior layer 154 of leather or synthetic leather for durability. Additionally, a stiffener (not shown) may be inserted in the heel strap 150 for stiffness and added durability.

An outer end 156 of the heel strap 150 is attached to the outer support member 68 by an outer pivot connection 158, and an inner end 160 of the heel strap 150 is attached to the inner support member 66 by an inner pivot connection 162. The inner and outer pivot means 158 and 162 preferably include inner and outer heel rivets 164 and 166 having inner and outer heel rivet pins 168 and 170 and inner and outer heel rivet heads 172 and 174.

The outer heel rivet pin 170 passes through apertures 174 and 176 defined by the outer end 156 of the heel strap 150 and the exterior layer 86 of the outer support member 68. The outer heel rivet head 172 is affixed to the outer heel rivet pin 170 to hold the pin 170 in place.

The inner heel rivet pin 168 passes through apertures 178 and 180 defined by the inner end 160 of the heel strap 150 and the exterior layer 84 of the inner support member 66. The inner heel rivet head 172 is affixed to the inner heel rivet pin 168 to hold the pin 168 in place.

Preferably, neither rivet pin 168 or 170 is exposed on the interior layer 80 or 82 of the inner or outer support members 66 or 68. These pins 168 and 170 pass through only the exterior layers 84 and 86 of the support members 66 and 68 and are covered by the material comprising the interior layer 80 and 82 of the support members 66 and 68. Thus, the wearer's foot 24 is not irritated or chafed by the rivet pins 168 and 170.

The sandal 10 is worn by the wearer by unbuckling the buckles 51 and 108 attached to the front strap 50 and the ankle strap 88 and adjusting the straps 150 and 88 to the size of the wearer's foot 24. The wearer slips his or her foot 24 between the heel and the ankle straps 150 and 88 and forward between the front strap 50 and the sole 20. He or she may then buckle the front and ankle straps 150 and 88 and tighten the straps 150 and 88 to secure the foot 24 against the sole 20. As the ankle strap 88 is tightened, it rotates to a preferred position on the wearer's foot 24, namely between the ankle and the top portion of the wearer's foot 24. The heel strap 150 typically rotates as the wearer slips a foot 24 into the sandal 10 to above the heel. However, the wearer may also position the ankle strap 88 and the heel strap 150 in other comfortable positions, taking into account the wearer's instep height and heel height; typically, the ankle strap 88 fits most comfortably at the top edge of the foot 24, and the heel strap 150 fits most comfortably directly above the heel. The wearer may pivot the ankle and heel straps 88 and 150 to any position he or she wishes.

Further, attaching the ankle strap 88 and the heel strap 150 directly to the inner and outer support members 66 and 68 provides lateral support to the foot. The straps 88 and 150 do not have any independent lateral movement; they move only in conjunction with the support members 66 and 68 due to being securely attached to them. This restricted movement of the straps 88 and 150 helps to stiffen the sandal 10 and minimize lateral movement of the foot 24.

In an alternative embodiment, as seen in FIGS. 8–11, the inner and outer support members 200 and 202 extend around the rear 204 of the sandal 206 to form the heel strap 208. Such a heel strap 208 is not pivotable; however, the ankle strap 210 remains pivotally affixed to the inner and outer support members 200 and 202.

In the alternative embodiment, the ankle strap 210 includes interior and exterior layers 212 and 214, the interior layer 210 preferably constructed of neoprene covered with spandex, although other pliable materials may be used. The exterior layer 214 is preferably comprised of leather bonded with a stiffener or other appropriately durable material. The exterior layer 214 includes inner and outer edges 216 and 218. Each edge 216 or 218 loops through an inner or outer connector 220 or 222 and attaches back onto itself. The inner edge 216 may be re-attached by a hook and loop fastener, such as Velcro, or in another releasable manner to allow the wearer to adjust the length of the strap 210.

Apertures 224 and 226 are defined by the inner connector 220 and the exterior layer 227 of the inner support member 200. An inner ankle rivet pin 228 passes through these apertures 224 and 226 and is secured with an inner ankle rivet head 230. Apertures 232 and 234 are defined by the outer connector 222 and the exterior layer 235 of the outer support member 202. An outer ankle rivet pin 236 passes through these apertures 232 and 234 and is secured with an outer ankle rivet head 238. Thus, the ankle strap 210 is secured at its inner and outer ends 216 and 218 to the inner and outer support members 200 and 202, and the ankle strap 210 may be pivoted by the wearer on the rivet pins 228 and 236.

In the alternative embodiment, the wearer may adjust the length of the ankle strap 210 by means of the inner end portion 216 passing through the inner connector 220. The wearer slips his foot between the pivotable ankle strap 210 and the stationary heel strap 208 and forward between the front strap 240 and the sole 242. The ankle strap 210 rotates to a preferred position, typically between the wearer's ankle and top portion of the foot. However, the wearer may adjust the position of the ankle strap 210 for comfort.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A sandal comprising a sole and a strap system for retaining said sole on a foot, said strap system including:

a first strap said, first strap including an inner end an outer end and a middle portion;

inner and outer support members having upper and lower portions, said lower portions of said inner and outer supporting members affixed to said sole, said first strap pivotally attached directly to said inner and outer support members; and inner and outer first rivet pins, said inner first rivet pin passing through an aperture defined by said inner support member and through an aperture defined by said inner end of said first strap, thereby pivotally securing said inner end of said first strap to said inner support member, said outer first rivet pin passing through an aperture defined by said outer support member and through an aperture defined by said outer end of said first strap, thereby pivotally securing said outer end of said first strap to said outer support member, said inner and outer first rivet pins secured by inner and outer first rivet heads;

said inner and outer support members including a cushioned interior layer and a flexible exterior layer, said inner first rivet head positioned between said interior layer and said exterior layer of said inner support member and said outer first rivet head positioned between said interior layer and said exterior layer of said outer support member, whereby said rivet heads are not exposed on an interior of said sandal.

2. The sandal of claim 1 wherein said first strap is an ankle strap and said sandal further comprises:

a heel strap having inner and outer ends and a middle portion, said inner end pivotally attached to said inner support member by an inner heel rivet, said inner heel rivet including an inner heel rivet pin passing through an aperture defined by said inner support member and an aperture defined by said inner end of said heel strap, said inner heel rivet pin secured by an inner heel rivet head, said outer end pivotally attached to said outer support member by an outer heel rivet, said outer heel rivet including an outer heel rivet pin passing through an aperture defined by said outer support member and an aperture defined by said outer end of said heel strap, said outer heel rivet pin secured by an outer heel rivet head.

3. A foot wear construction comprising:

a sole having front and rear portions;

inner and outer support members, each including upper and lower portions, said lower portions affixed to said rear portion of said sole;

a first strap having inner and outer ends and pivotally attached to said upper portions of said inner and outer support members;

an inner first pivot means directly affixing said inner end of said first strap to said upper portion of said inner support member, whereby said first strap rotates around said pivot means; and an outer first pivot means affixing said outer end of said first strap to said upper portion of said outer support member, whereby said first strap rotates around said pivot means, said inner and outer first pivot means including inner and outer rivet pins and rivet heads, said inner rivet pin passing through apertures defined by said inner end of said first strap and by said inner support member, said outer rivet pin passing through apertures defined by said outer end of said first strap and by said outer support member, said inner and outer rivet pins secured by said inner and outer rivet heads;

said support members including a cushioned interior layer and a flexible exterior layer, said inner rivet head positioned between said interior layer and said exterior layer of said inner support member and said outer rivet head positioned between said interior layer and said exterior layer of said outer support member, whereby said inner and outer rivet heads are not exposed on an interior of said sandal.

4. The construction of claim 3 wherein said first strap is an ankle strap, said sandal further comprising:

a heel strap having inner and outer ends and a middle portion, said inner end pivotally attached to said inner support member by an inner heel rivet, said inner heel rivet including an inner heel rivet pin passing through an aperture defined by said inner support member and an aperture defined by said inner end of said heel strap, said inner heel rivet pin secured by an inner heel rivet head, said outer end pivotally attached to said outer support member by an outer heel rivet, said outer heel rivet including an outer heel rivet pin passing through an aperture defined by said outer support member and an aperture defined by said outer end of said heel strap, said outer heel rivet pin secured by an outer heel rivet head.

5. A sandal comprising a sole and a strap system for retaining said sole on a foot, said strap system including:

inner and outer substantially vertical support members, lower portions of said support members affixed to said sole; and an ankle strap having inner and outer ends and a middle portion, said inner end pivotally attached to said inner support member by an inner ankle rivet, said inner ankle rivet including an inner ankle rivet pin passing through an aperture defined by said inner support member and an aperture defined by said inner end of said ankle strap, said outer end pivotally attached to said outer support member by an outer ankle rivet, said outer ankle rivet including an outer ankle rivet pin passing through an aperture defined by said outer support member and an aperture defined by said outer end of said ankle strap, said inner and outer ankle rivet pins secured by inner and outer ankle rivet heads, said support members including a cushioned interior layer and a flexible exterior layer, said inner ankle rivet head positioned between said interior layer and said exterior layer of said inner support member and said outer ankle rivet head positioned between said interior layer and said exterior layer of said outer support member, whereby said inner and outer ankle rivet heads are not exposed on an interior of said sandal.

* * * * *

UNITED STATES PATENT AND TRADEMARK OFFICE

CERTIFICATE OF CORRECTION

PATENT NO. : 6,256,906 B1
DATED : July 10, 2001
INVENTOR(S) : Clark A. Matis et al.

It is certified that error appears in the above-identified patent and that said Letters Patent is hereby corrected as shown below:

Column 6, claim 1,
Line 29, "a first strap said," should be -- a first strap, said --; and after "inner end" insert -- , --

Signed and Sealed this

Sixteenth Day of April, 2002

*Attest:*

*Attesting Officer*

JAMES E. ROGAN
*Director of the United States Patent and Trademark Office*